US009211892B1

(12) United States Patent
Combs et al.

(10) Patent No.: US 9,211,892 B1
(45) Date of Patent: Dec. 15, 2015

(54) MONITORING DEVICE FOR A RAILCAR CONTROL VALVE

(75) Inventors: James Combs, Lexington, KY (US); Theodore O'Canna, Versailles, KY (US)

(73) Assignee: Lexair, Inc., Lexington, KY (US)

( * ) Notice: Subject to any disclaimer, the term of this patent is extended or adjusted under 35 U.S.C. 154(b) by 833 days.

(21) Appl. No.: 13/468,186

(22) Filed: May 10, 2012

Related U.S. Application Data

(60) Provisional application No. 61/484,751, filed on May 11, 2011.

(51) Int. Cl.
*G06F 11/30* (2006.01)
*B61D 7/14* (2006.01)
*B61D 7/30* (2006.01)

(52) U.S. Cl.
CPC ... *B61D 7/14* (2013.01); *B61D 7/30* (2013.01)

(58) Field of Classification Search
CPC ..... B61D 7/28; B61D 7/30; B61D 7/26; B61D 7/24; B61D 7/16; B61D 7/14; B61D 7/00; B61D 7/06; B61D 7/02; B61D 9/14
USPC ..... 702/182
See application file for complete search history.

(56) References Cited

U.S. PATENT DOCUMENTS

| | | | | |
|---|---|---|---|---|
| 4,156,286 | A | 5/1979 | Connors et al. | |
| 4,285,483 | A | 8/1981 | Cipollone | |
| 5,065,321 | A | 11/1991 | Bezos et al. | |
| 5,185,700 | A | 2/1993 | Bezos et al. | |
| 5,267,473 | A | 12/1993 | Bezos et al. | |
| 5,623,416 | A | 4/1997 | Hocker, III | |
| 6,175,784 | B1 * | 1/2001 | Jicha et al. | 701/19 |
| 6,557,452 | B1 * | 5/2003 | Morroney et al. | 91/465 |
| 7,093,544 | B1 | 8/2006 | Allen et al. | |
| 7,328,661 | B1 | 2/2008 | Allen et al. | |
| 7,769,509 | B2 | 8/2010 | Gaughan et al. | |
| 7,770,847 | B1 * | 8/2010 | Severson | 246/3 |
| 2006/0065501 | A1 * | 3/2006 | Taylor | 191/49 |
| 2007/0084378 | A1 * | 4/2007 | Creighton et al. | 105/247 |
| 2009/0254277 | A1 * | 10/2009 | Davey et al. | 701/213 |
| 2010/0132588 | A1 * | 6/2010 | Fry et al. | 105/286 |

* cited by examiner

*Primary Examiner* — Mischita Henson
*Assistant Examiner* — Stephanie Bloss
(74) *Attorney, Agent, or Firm* — Stites & Harbison, PLLC; David W. Nagle, Jr.

(57) ABSTRACT

A monitoring device for a control valve on a railcar comprises a microcontroller that includes a memory component, along with a voltage sensor that is in electrical communication with one or more solenoids associated with the control valve. When a selected solenoid is actuated, the voltage sensor reads a voltage and communicates the voltage to the microcontroller, with the microcontroller storing the voltage and other pertinent data in the memory component.

11 Claims, 3 Drawing Sheets

MONITORING DEVICE FOR A RAILCAR CONTROL VALVE

CROSS-REFERENCE TO RELATED APPLICATIONS

The present application claims priority to U.S. Provisional Patent Application Ser. No. 61/484,751 filed on May 11, 2011, the entire disclosure of which is incorporated herein by reference.

BACKGROUND OF THE INVENTION

The present invention relates to a railcar control valve.

Railcars, specialized dump trucks, and similar vehicles are used to transport large amounts of raw materials (for example, coal) from one place to another. Some of these vehicles are constructed with pneumatic or hydraulic systems that actuate mechanical doors to facilitate or automate unloading of the vehicle at unloading facilities. A bottom dump railcar is a good example of this kind of automation. Such a railcar is constructed with a pneumatic system, including a control valve and cylinder, which works in conjunction with mechanical linkages to operate the bottom doors when the railcar is located over the appropriate unloading facility. The control valve can be actuated by manual levers, by manual pneumatic push buttons, or by one or more electrical solenoids. The source of electricity for actuating the control valve solenoid (or solenoids) is usually external to the railcar. A sliding contact, which is generally referred to a "hot shoe," is affixed to the railcar at a convenient location and electrically isolated from the body of the railcar. The hot shoe is connected electrically to one lead of the solenoid (or solenoids). The other lead of the solenoid is connected to the body of the railcar, which is, in turn, operably connected to the rails via the trucks and wheels. When the railcar is pulled by the unloading facility, the hot shoe makes contact with an electrified contact, completing a path from the hot shoe to the solenoid and to the rail on the ground, resulting in actuation of the control valve. For further description of the construction and operation of such a control valve for a bottom dump railcar, reference is made to commonly assigned U.S. Pat. Nos. 7,093,544 and 7,328,661, which are both entitled "Control Device for a Railroad Car" and are incorporated herein by reference.

Such a control system, while simple, reliable, and convenient, has the possibility of improper operation by careless operators as well as abuse by individuals who have knowledge of the system for nefarious purposes. It would be desirable to be able to monitor various electrical parameters of the control valve and its operation for diagnostics and historical performance, including, but not limited to, monitoring when and where the control valve was operated, as well as the voltage level, current level, signal duration, and other electrical characteristics, and possibly the position of the control valve prior to or after actuation.

SUMMARY OF THE INVENTION

The present invention is a monitoring device for a railcar control valve, which monitors the operation of the railroad control valve and the doors associated with such a railroad control valve.

An exemplary monitoring device for a railcar control valve made in accordance with the present invention logs any electrical voltage applied to the signal lines of a control valve solenoid (or solenoids). The monitoring device thus includes:

a power regulator; a programmable microcontroller with on-board memory components and one or more timers; a real-time clock and associated battery; and an analog-to-digital converter or other voltage sensor.

Each solenoid is in electrical communication with the monitoring device. Once one of the solenoids is actuated, the power regulator uses the voltage for operating the solenoids and "powers up" the components of the monitoring device. Thus, the monitoring device has no independent electrical power source and remains inoperable and in a passive mode until one of the solenoids is actuated.

The solenoids used in opening and closing the doors of a railcar are only connected to an electrical power source and actuated at an unloading facility. In this regard, a hot shoe is affixed to a railcar at a convenient location and is electrically isolated from the body of the railcar. When the railcar arrives at the unloading facility, the hot shoe makes contact with a first electrified contact, completing a path from the hot shoe to the solenoids. When the hot shoe makes contact with the first electrified contact, this actuates one solenoid, and the doors of the railcar are opened. As the railcar continues to advance, the hot shoe breaks contact with the first electrified contact and makes contact with a second electrified contact, which actuates another solenoid, and the doors of the railcar are closed.

Once one of the solenoids is actuated, the analog-to-digital converter "senses" and reads the voltage on the line and communicates that to the microcontroller of the monitoring device. The microcontroller then initializes its data collection routine, recording all pertinent data, including, for example, the identification of the solenoid actuated, the voltage, the time/date of the actuation, and the duration of the actuation. Thus, all pertinent data associated with each actuation of one of the solenoids is recorded and stored.

DETAILED DESCRIPTION OF THE INVENTION

The present invention is a monitoring device for a railcar control valve, which monitors the operation of the railroad control valve and the doors associated with such a railroad control valve.

Figure 1:
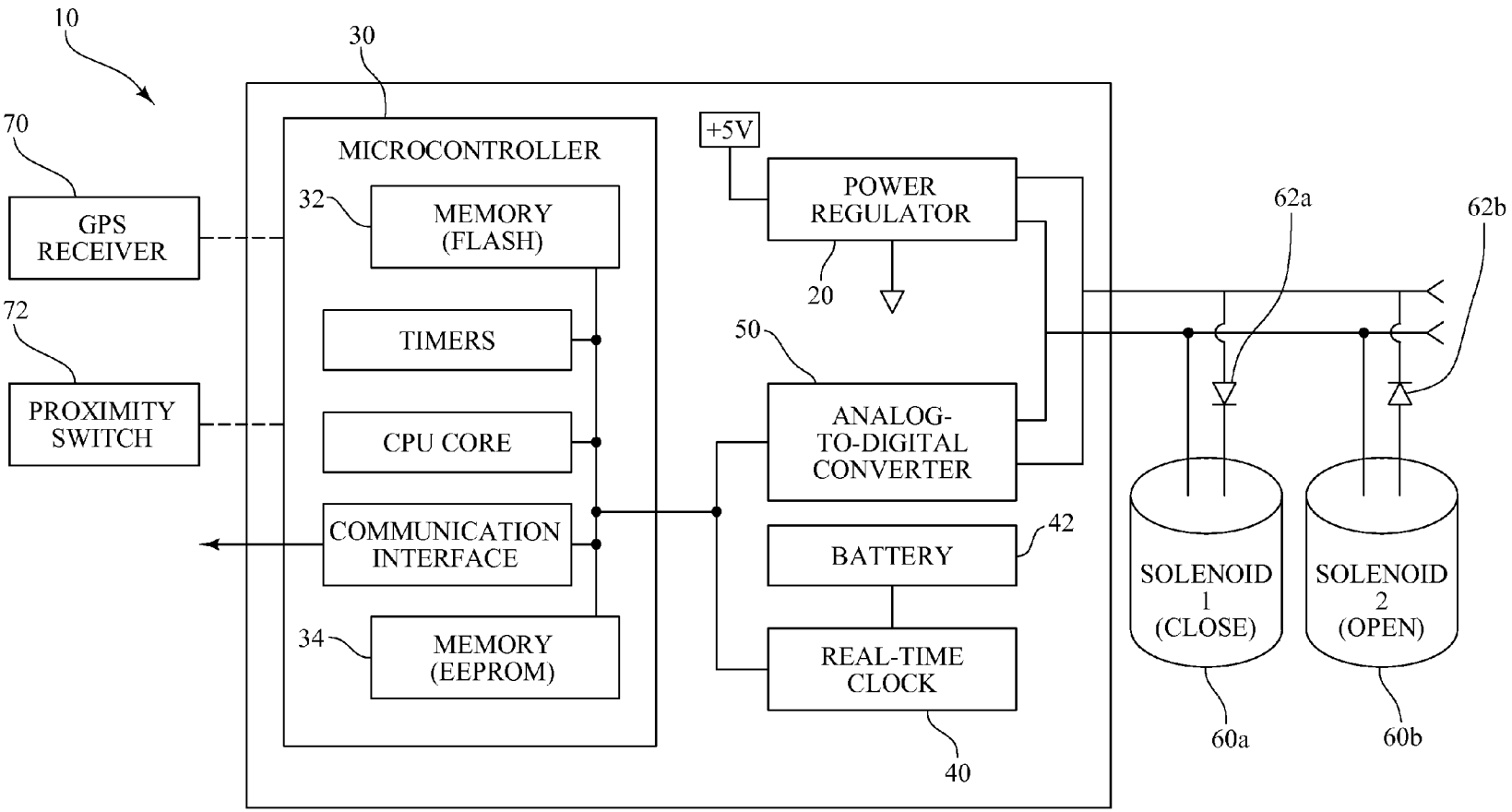
FIG. 1 is a schematic diagram of an exemplary monitoring device made in accordance with the present invention.

Referring now to FIG. 1, an exemplary monitoring device 10 for a railcar control valve made in accordance with the present invention logs any electrical voltage applied to the signal lines of a control valve solenoid (or solenoids). The monitoring device 10 thus includes: a power regulator 20; a programmable microcontroller 30 with on-board memory components 32, 34 and one or more timers 36; a real-time clock 40 and associated battery 42; and an analog-to-digital converter 50. For example, one suitable microcontroller for use in the monitoring device 10 of the present invention is a Model No. AT90S2313 Microcontroller manufactured and distributed by Atmel Corporation of San Jose, Calif.

Referring still to FIG. 1, each solenoid 60*a*, 60*b* is in electrical communication with the monitoring device 10. Specifically, in this exemplary embodiment, each solenoid 60*a*, 60*b* is in electrical communication with the power regulator 20 and the analog-to-digital converter 50. With respect to the power regulator 20, once one of the solenoids 60*a*, 60*b* is actuated, the power regulator 20 uses the voltage for operating the solenoids 60*a*, 60*b* and "powers up" the components of the monitoring device 10. Thus, the monitoring device 10 has no independent electrical power source and remains inoperable and in a passive mode until one of the solenoids 60*a*, 60*b* is actuated. In this regard, the battery 42 is intended only as a power source for the real-time clock 40.

Figure 3:
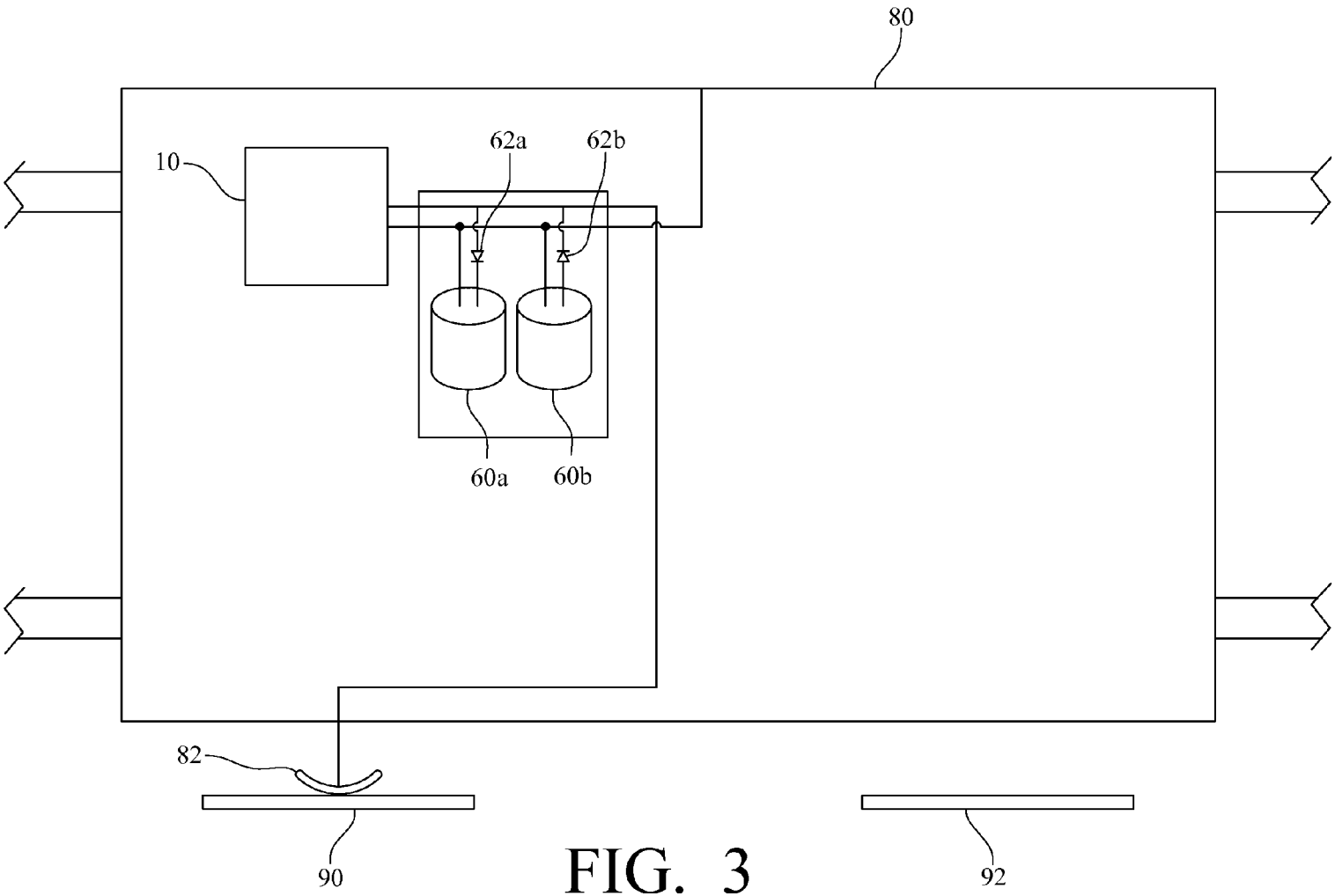
FIG. 3 is a schematic (plan) view of a railcar incorporating the exemplary monitoring device of FIG. 1.

With respect to the actuation of the solenoids 60*a*, 60*b*, and as mentioned above, the solenoids 60*a*, 60*b* used in opening and closing the doors of a railcar are only connected to an electrical power source and actuated at an unloading facility. Specifically, as shown in the schematic view of FIG. 3, a hot shoe 82 is affixed to a railcar 80 at a convenient location and electrically isolated from the body of the railcar 80. The hot shoe 82 is electrically connected to one lead of the solenoids 60*a*, 60*b*, and the solenoids 60*a*, 60*b* are also electrically connected to the body of the railcar 80, which is, in turn, operably connected to the rails via the trucks and wheels. When the railcar 80 arrives at the unloading facility, the hot shoe 82 makes contact with a first electrified contact 90, completing a path from the hot shoe 82 to the solenoids 60*a*, 60*b*. A diode 62*a*, 62*b* is associated with each of the solenoids 60*a*, 60*b*, and thus, the voltage polarity, in conjunction with the diodes 62*a*, 62*b*, determines which solenoid 60*a*, 60*b* is energized. In this case, when the hot shoe 82 makes contact with the first electrified contact 90, this actuates the solenoid 60*b* through the associated diode 62*b*, and the doors of the railcar 80 are opened. As the railcar 80 continues to advance, the hot shoe 82 breaks contact with the first electrified contact 90 and makes contact with a second electrified contact 92 (which has an opposite polarity as compared to the first electrified contact 90), which actuates the other solenoid 60*a* through an associated diode 62*a*, and the doors of the railcar 80 are closed. As also mentioned above, for further description of the construction and operation of such a control valve for a bottom dump railcar, reference is made to commonly assigned U.S. Pat. Nos. 7,093,544 and 7,328,661, which are both entitled "Control Device for a Railroad Car" and are incorporated herein by reference.

Referring again to FIG. 1, the analog-to-digital converter 50 of the monitoring device 10 effectively serves as a voltage sensor. In other words, once one of the solenoids 60*a*, 60*b* is actuated, the analog-to-digital converter 50 "senses" and reads the voltage on the line and communicates that to the microcontroller 30 of the monitoring device 10. The microcontroller 30 then initializes its data collection routine, recording all pertinent data, including, for example, the identification of the solenoid actuated, the voltage, the time/date of the actuation, and the duration of the actuation.

With respect to the communication of the pertinent data from the analog-to-digital converter 50 to the microcontroller 30, in this exemplary embodiment, the microcontroller 30 uses a serial bus for communication to both the analog-to-digital converter 50 and the real-time clock 40. Thus, an industry-standard I2C communications bus is integrated into the analog-to-digital converter 50 and the real-time clock 40. This communications bus works by sending a device address out on the bus, along with a read/write bit and a command byte. The addressed device, either the analog-to-digital converter 50 or the real-time clock 40, then responds to the address/command and communicates the requested data back to the microcontroller 30. All collected data is then stored in the memory (non-volatile) component 34 of the microcontroller 30.

As a result, all pertinent data associated with each actuation of one of the solenoids 60*a*, 60*b* (i.e., an "event") is recorded and stored. Subsequent events are logged until the capacity of the memory (non-volatile) component 34 is reached. After such time, the monitoring device 10 begins to overwrite the oldest data, thus ensuring the most recent events are available for retrieval. In this regard, data may be retrieved by communication with an external device, such as a laptop computer or smart phone, via a communications interface 38 or other port utilizing an appropriate communications protocol. Such a communications interface 38 or other port can also provide external power to the monitoring device 10 for the purposes of data retrieval.

Figure 2:
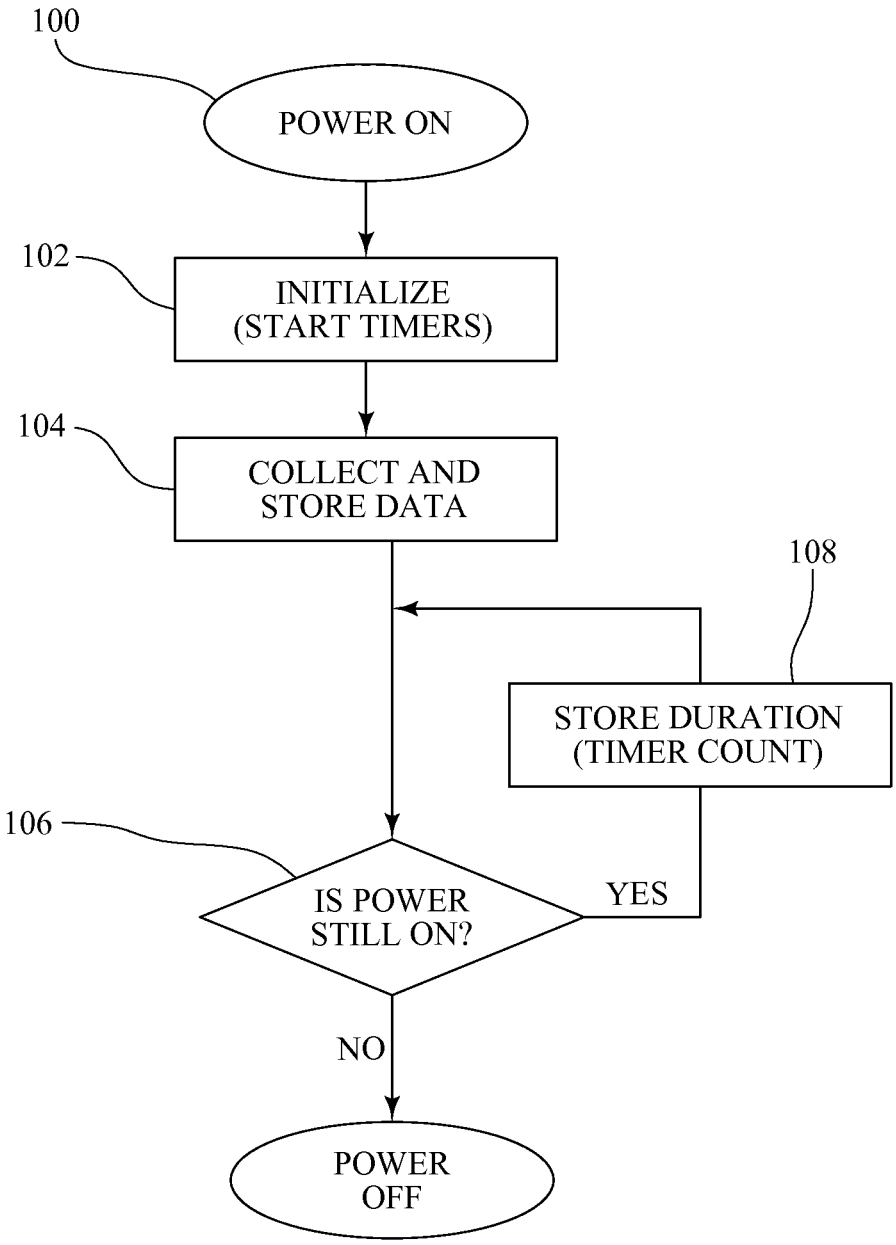
FIG. 2 is a flow chart illustrating operation of the exemplary monitoring device of FIG. 1.

For further description of the exemplary monitoring device 10, reference is also made to FIG. 2, which is a flow chart that summarizes the operation of the monitoring device 10. Once one of the solenoids 60*a*, 60*b* is actuated, the monitoring device 10 powers on and initializes, as indicated by terminal 100 and block 102 in FIG. 2. The monitoring device 10 then collects and stores all pertinent data, including the identification of the solenoid actuated, the voltage, and the time/date of the actuation, as reflected in block 104 of FIG. 2. As long as the power is still on, as reflected by decision 106 in FIG. 2, the duration (timer count) of the actuation is also stored, as indicated by block 108 in FIG. 2 The recordation and storage of data continues as long as the monitoring device 10 is powered on.

As a further refinement and referring back to FIG. 1, the monitoring device 10 may be provided with a global positioning satellite (GPS) receiver 70 that determines and communicates the position of the railcar at the time an event occurs, and that position data is also recorded and stored.

As a further refinement and referring still to FIG. 1, the monitoring device 10 may also be provided with or connected to a proximity switch, reed switch, or other position sensor 72 to determine a position of the control valve, and that control valve position data is also recorded and stored.

One of ordinary skill in the art will recognize that additional embodiments are possible without departing from the teachings of the present invention or the scope of the claims which follow. This detailed description, and particularly the specific details of the exemplary embodiment disclosed herein, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A method for monitoring operation of a railcar with one or more doors, comprising the steps of, in response to a hot shoe of the railcar making contact with a first electrified contact at a first voltage level:

actuating a first control valve to open a selected door of the railcar;

providing power to a microcontroller by a power regulator in electrical communication with the hot shoe of the railcar;

recording, in a memory component of the microcontroller, the first voltage level and a current time/date value;

recording in the memory component of the microcontroller a first timer value representing a time duration since the hot shoe of the railcar made contact with the first electrified contact; and in response to the hot shoe of the railcar breaking contact with the first electrified contact, removing power to the microcontroller by the power regulator.

2. The method as recited in claim 1, wherein the first control valve is actuated by a first solenoid that is electrically connected to the first electrified contact via the hot shoe.

3. The method as recited in claim 1, and further comprising the steps of, in response to the hot shoe of the railcar making contact with a second electrified contact at a second voltage level:

actuating a second control valve to close the selected door of the railcar;

providing power to the microcontroller by the power regulator in electrical communication with the hot shoe of the railcar; and recording, in the memory component of the microcontroller, the second voltage level and the current time/date value.

4. The method as recited in claim 3, wherein the second control valve is actuated by a second solenoid that is electrically connected to the second electrified contact via the hot shoe.

5. The method as recited in claim 3, and further comprising the steps of:

recording in the memory component of the microcontroller, a timer value representing a time duration since the hot shoe of the railcar made contact with the second electrified contact; and in response to the hot shoe of the railcar breaking contact with the second electrified contact, removing power to the microcontroller by the power regulator.

6. A system for monitoring operation of a railcar with one or more doors, comprising:

a hot shoe of the railcar for making contact with a first electrified contact at a first voltage level;

a first solenoid electrically connected to the hot shoe, the first solenoid actuating a first control valve for opening a selected door of the railcar when the hot shoe of the railcar makes contact with the first electrified contact;

a power regulator in electrical communication with the hot shoe of the railcar, the power regulator producing power when the hot shoe of the railcar makes contact with the first electrified contact; and a microcontroller in electrical communication with the power regulator, the microcontroller comprising a memory component, the microcontroller recording in the memory component the first voltage level and a current time/date value when the hot shoe of the railcar makes contact with the first electrified contact.

7. The system for monitoring operation of a railcar as recited in claim 6, wherein the microcontroller further comprises a timer, the timer generating a first timer value representing a time duration since the hot shoe of the railcar made contact with the first electrified contact, the microcontroller recording in the memory component the first timer value; and wherein the power regulator removes power to the microcontroller in response to the hot shoe of the railcar breaking contact with the first electrified contact.

8. The system for monitoring operation of a railcar as recited in claim 7, further comprising:

a second electrified contact at a second voltage level, the hot shoe of the railcar also for making contact with the second electrified contact at the second voltage level; and a second solenoid electrically connected to the hot shoe, the second solenoid actuating a second control valve for closing the selected door of the railcar when the hot shoe of the railcar makes contact with the second electrified contact;

the power regulator producing power when the hot shoe of the railcar makes contact with the second electrified contact when the hot shoe of the railcar makes contact with the second electrified contact; and the microcontroller recording in the memory component the second voltage level and the current time/date value when the hot shoe of the railcar makes contact with the second electrified contact.

9. The system for monitoring operation of a railcar as recited in claim 8, wherein the timer generates a second timer value representing a time duration since the hot shoe of the railcar made contact with the second electrified contact, the microcontroller recording in the memory component the second timer value; and wherein the power regulator removes power to the microcontroller in response to the hot shoe of the railcar breaking contact with the second electrified contact.

10. The system for monitoring operation of a railcar as recited in claim 6, and further comprising a global positioning satellite receiver, with the microcontroller receiving and storing position data from the global positioning satellite receiver in the memory component.

11. The system for monitoring operation of a railcar as recited in claim 6, and further comprising a proximity sensor, with the microcontroller receiving and storing control valve position data from the proximity sensor in the memory component.

* * * * *